US006139689A

United States Patent [19]

Polston et al.

[11] Patent Number: 6,139,689

[45] Date of Patent: Oct. 31, 2000

[54] APPARATUS FOR DIGESTING PULP IN A DISPLACEMENT BATCH DIGESTER THAT USES DISPLACEMENT LIQUOR HAVING A SUFFICIENT HYDROSTATIC HEAD

[75] Inventors: Jeremiah W. Polston, Bennettsville, S.C.; Raymond J. Pitre, Jacksonville, Fla.; Helmut Böhm, Asten, Austria

[73] Assignee: Beloit Technologies, Inc., New Berlin, Wis.

[21] Appl. No.: 08/872,711

[22] Filed: Jun. 11, 1997

[51] Int. Cl.[7] ..... D21C 7/14

[52] U.S. Cl. ..... 162/242; 162/248; 162/249

[58] Field of Search ..... 162/59, 249, 248, 162/41, 242, 42, 43, 44, 45, 52, 246

[56] References Cited

U.S. PATENT DOCUMENTS

| | | | |
|---|---|---|---|
| 2,671,727 | 3/1954 | Westcott et al. | 162/62 |
| 4,568,422 | 2/1986 | Armstrong et al. | 162/238 |
| 4,578,149 | 3/1986 | Fagerlund . | |
| 4,601,787 | 7/1986 | Fagerlund . | |
| 4,849,052 | 7/1989 | Grant . | |
| 5,059,281 | 10/1991 | Andrews . | |
| 5,059,284 | 10/1991 | Fagerlund . | |
| 5,080,757 | 1/1992 | Fagerlund . | |
| 5,116,475 | 5/1992 | Edlund et al. | 162/52 |
| 5,536,366 | 7/1996 | Marcoccia et al. | 162/248 |

FOREIGN PATENT DOCUMENTS

| | | |
|---|---|---|
| WO 94/25669 | 4/1994 | WIPO . |
| WO 95/23891 | 3/1995 | WIPO . |

*Primary Examiner*—Steve Alvo
*Attorney, Agent, or Firm*—Hill & Simpson

[57] ABSTRACT

An apparatus and method for use in a displacement batch digesting process is provided which reduces the amount of equipment required to carry out an efficient displacement batch digestion process. Specifically, an apparatus and method are disclosed which eliminates the need for separate warm fill pumps, hot fill pumps and further which consolidates the cool pad pump, displacement pump and dilution pump functions into a single booster pump. Still further, the recirculation pump and discharge pump functions are consolidated into a single pump.

10 Claims, 4 Drawing Sheets

APPARATUS FOR DIGESTING PULP IN A DISPLACEMENT BATCH DIGESTER THAT USES DISPLACEMENT LIQUOR HAVING A SUFFICIENT HYDROSTATIC HEAD

BACKGROUND OF THE INVENTION

The present invention relates generally to improvements in methods and apparatus for the batch digesting of cellulosic material such as wood chips, and more particularly to a process and apparatus for reducing the amount of equipment necessary for the construction of displacement batch digester cooking systems.

In conventional batch processes for digesting wood chips, the digester is filled with chips before being charged with the cooking liquor which typically includes sodium hydroxide and, in a kraft process, further includes a sulfur compound. The digester is then sealed and, with steam, the temperature of the digester is brought up to a cooking temperature at which the digester is maintained for a period of time referred to as "the cook". At the conclusion of the cook, a blow valve in the digester is opened, and the contents of the digester are then discharged into a blow tank by virtue of the hot liquor in the digester flashing into steam and forcing the delignified pulp out of the digester.

In the conventional batch process described above, much of the heat energy acquired by the contents of the digester during the process exits through the blow tank with the exhaust vapors. To date, the most successful attempts at recovering this heat energy include displacement heating systems which are disclosed in U.S. Pat. Nos. 4,578,149, 4,601,787, 5,059,284 and 5,080,757, all of which are commonly assigned to Beloit Corporation of Beloit, Wis. The systems disclosed in these patents utilize what is commonly referred to as liquid displacement technology and the systems themselves are commonly referred to as displacement batch digester cooking systems.

In a displacement batch digester cooking system, at the end of a cook, the digester is held under pressure and a displacement liquid is used to displace the hot black or spent liquors under pressure resulting in a displacement of the hot black liquor out of the digester at the cooking temperature. After being displaced from the digester, the hot black liquor is collected in a high temperature accumulator. The typical displacement fluid is filtrate obtained from washing the pulp or delignified fibers obtained in the earlier digestion of chips in other batches. The filtrate has a temperature elevated from the usual room or ambient temperature because it has already been passed through warm, delignified fibers. Thus, while the filtrate has a temperature of less than the hot black or spent liquor, it may still have a temperature of about 70° C.

In the digester, the filtrate will absorb heat from the solids in the digester and its temperature will increase. Accordingly, a remaining portion of the hot spent liquor and a portion of the now-heated filtrate contain a sufficient amount of heat that is worth saving. Thus, the remaining hot black liquor and a portion of filtrate are stored in a low temperature accumulator. The rest of the filtrate is used in draining the digester and removing the delignified pulp.

Then, to begin a new batch, the digester is filled with new wood chips. To utilize the energy retained in the low temperature accumulator, the low temperature mixture which comprises a portion of the hot spent black liquor from the previous batch and filtrate used to displace the hot spent black liquor is transferred from the low temperature accumulator to the digester. As a result, the chips are heated.

After treatment with the fluid from the low temperature accumulator, liquor from the high temperature accumulator is pumped into the digester to displace the fluid from the low temperature accumulator. The fluid from the high temperature accumulator consists mostly of the hot spent black liquor from the previous batch. As a result of being immersed in the liquid from the high temperature accumulator, the temperature of the wood chips or solids is raised again.

As a final displacement process, a portion of the fluid from the high temperature accumulator is displaced by a mixture of hot black liquor from the high temperature accumulator and hot white liquor from a hot white liquor accumulator. The resulting mixture is used as the cooking liquid. After the cook, the cycle begins again with the displacement of the spent cooking fluid with washer filtrate.

In prior art systems using the above-described general process, separate booster pumps are required to transfer fluid from the low temperature and high temperature accumulators and the digester. Further, a booster pump is required to transfer hot white liquor from the hot white liquor accumulator and the digester. An example of the complexity and number of booster pumps required is illustrated in FIG. 1.

Specifically, a system 10 is illustrated which includes a digester 11 and communication by way of a series of valves and conduits to a filtrate reservoir or tank 12, a low temperature accumulator 13, a pair of high temperature accumulators 14, 15, a hot white liquor accumulator 16 and a cool tank 17. As discussed above, filtrate from the filtrate reservoir 12 is used to displace spent hot black liquor from the digester 10 after the cook. Thus, filtrate from the filtrate reservoir 12 is pumped toward the digester 11 by way of a conduit 17, a filtrate displacement pump 18, a conduit 19, through a valve 20, a valve 22, a conduit 23 and into a lower end 24 of the digester 11.

Powered by the displacement pump 18, the filtrate displaces the hot spent liquor out an upper end 25 of the digester 11 by way of a conduit 26, valves 27 and 28, a conduit 31 and valves 32 and 33 before entering high temperature accumulators 14 and 15 respectively. For purposes of clarity, the high temperature accumulator 15 is intended to receive the first portion of the hot spent liquor after the cook and therefore has the highest temperature. Accordingly, the hot spent liquor from the cook enters the accumulator 15 through the valve 33 first while the valve 32 is closed, thereby isolating the high temperature accumulator 14 from the conduit 31 temporarily. Then, as the accumulator 15 reaches capacity, the valve 33 is closed and additional hot spent liquor proceeds through the valve 32 into the high temperature accumulator shown at 14. Circumstances may also arise where it is necessary to permit the hot liquor to flow through a valve 30 and into the low temperature accumulator 13.

A heater shown at 33 may be used to heat fluid in the high temperature accumulator 14 as it is circulated through a pump 34 and a valve 35. A valve 36 permits a make-up of fluid from the high temperature accumulator 14 into the high temperature accumulator 15. Further, an overflow of fluid from the high temperature accumulator 14 may flow through a conduit 37, a heat exchanger 38 and a conduit 39 into the low temperature accumulator 13. Similarly, overflow from the low temperature accumulator 13 passes through a trim cooler 41, through a valve 42 and into the cool tank 17. Overflow from the cool tank 17 is pumped by a pump 43 into a weak liquor storage tank and evaporation area (not shown).

After the spent liquor has been displaced with the filtrate, a preliminary displacement of filtrate with cold fluid from the tank 17 is pumped by a cool pad pump 44, through conduits 45 and 23 into the lower end 24 of the digester 11. The purpose of the cool pad displacement is to prevent flashing of any low temperature liquor from the low temperature accumulator 13 during the subsequent displacement. Filtrate displaced by the cool liquid during the cool pad displacement is returned through a valve 46, a conduit 47 and a valve 48 to the cool tank 17. The remaining filtrate and cool pad fluid are then displaced by liquid from the low temperature accumulator 13 which is pumped by a warm fill pump 51, through a conduit 52, valves 53 and 22 and the conduit 23 into the lower end 24 of the digester 11.

The typical temperature of the fluid from the low temperature accumulator 13 is about 125°C. This fluid is then displaced by fluid collectively pumped from accumulators 14 and 15. The typical temperature of fluid in the high temperature accumulator 14 is about 150°C. while a typical temperature for the high temperature accumulator 15 is about 165° C. Appropriate amounts are then drawn from each accumulator 14, 15 and pumped by a hot fill pump 54, through a valve 55, the valve 22 and the conduit 23 and into the lower end 24 of the digester 11. Displaced fluid from the low temperature accumulator 13 flows primarily through the return line 47 to the cool tank 17.

However, depending upon the condition of the low temperature fluid and other process variables such as the type of chips being digested, at least a portion of the low temperature liquor may be returned to the low temperature accumulator 13. After the low temperature liquor from the accumulator 13 has been displaced by liquor from the high temperature accumulators 14 and 15, at least a portion of the high temperature liquor is displaced by fresh hot white liquor from the accumulator 16.

The hot white liquor flows through a valve 56 and is pumped by the hot fill pump 54 into the lower end 24 of the digester. As hot white liquor is injected into the lower end 24 of the digester 11, excess hot liquor flows out the upper end 25 of the digester through the conduit 26, the valve 27, a valve 59 and into a conduit 60. Depending upon the temperature of the hot liquor, it will flow through the valve 61 into the low temperature accumulator 13 or through a valve 49 into the high temperature accumulator 14. A heater may be provided at 57 for the purpose of heating cool white liquor retrieved from a reservoir shown at 58 which has passed through the heat exchanger 38 to cool fluid flowing from the high temperature accumulator 14 to the low temperature accumulator 13. Cool white liquor also passes through a valve 81 before it is mixed with low temperature liquor in a conduit 82 during the warm fill and cool white liquor is also passed through a valve 83 before it is mixed with cool liquid in a conduit 84 during the cool pad procedure.

At this point, the digester is full of fresh hot white liquor from the accumulator 16 and hot liquor from the accumulators 14, 15 as well as the wood chips to be cooked. The cooking process is begun and, to increase the temperature inside the digester 11, a recirculation pump 61 is employed which draws fluid out of a recirculation conduit 62 disposed near the middle of the digester 11 and pumps the fluid through a digester heater 63 (which is typically heated with steam (not shown)) before the fluid passes through a valve 64 and reenters the top of the digester 11 through the conduit 26 and valve 65 and reenters the bottom 24 of the digester 11 through the conduit 23. During recirculation, the valves 27 is closed.

After the cook is completed, the hot liquor disposed in the digester 11 is displaced using filtrate from the reservoir 12 as discussed above. The filtrate is removed using a pump-out pump 66 which pumps the filtrate and pulp through the valve 67 and to a discharge tank (not shown). Additional fluid from the filtrate reservoir 12 is pumped by a dilution pump 75, through a conduit 76 and a valve 77 into the digester 11 which serves to assist in the flushing of the remaining filtrate and pulp out of the digester and to further cool the digester 11. During the subsequent recharge of the digester 11 with wood chips and during the initial injection of cool pad liquid from cool tank 17, air is permitted to escape through an air evacuation valve shown at 68. The wood chips are further initially packed with steam through a valve shown at 69. A relief valve is shown at 71 and additional condensate is discharged through a valve shown at 72.

As shown in FIG. 1, a large number of pumps are employed. Specifically, the hot fill pump 54 is needed between the high temperature accumulators 14, 15 and hot white liquor accumulator 16 and the digester. The warm fill pump 51 is needed between the low temperature accumulator 13 and the digester 11. Further, the separate cool pad pump 44 and dilution pump 18 are needed between the cool tank 17 and filtrate tank 12 and the digester 11 respectively.

Further, the separate dilution pump 75 is required between the filtrate reservoir 12 and the digester 11. The large number of pumps required adds to the capital cost and operating cost of the system. Further, in a typical system, ten digesters are operated simultaneously and therefore the large number of pumps required for each digester contributes greatly to the high capital costs and operating costs required to run these systems.

Accordingly, there is a need for an improved displacement batch digester cooking system which simply uses less equipment and, more specifically, fewer pumps and associated headers and instrumentation. Still further, the operation of a separate washer filtrate reservoir 12 and cool tank 17 with their associated pumps is costly both in terms of to capital and operating costs as well as space requirements. Accordingly, there is a need for an improved displacement batch digester system which incorporates fewer tanks as well as less pumps.

SUMMARY OF THE INVENTION

The present invention satisfies the aforenoted needs by providing an improved rapid displacement batch digester apparatus and method which incorporates less equipment in the form of pumps, headers and instrumentation than previously known apparatuses and methods resulting in lower capital and operating costs.

In accordance with the present invention, a displacement batch digesting apparatus is provided which includes a first inlet for selectively receiving displacement fluid in the form of filtrate from a filtrate reservoir, low temperature liquor from a low temperature liquor accumulator, high temperature liquor from a high temperature liquor accumulator and hot white liquor from a hot white liquor accumulator. The low temperature accumulator, high temperature accumulator and hot white liquor accumulator each being pressurized and further providing a sufficient hydrostatic head to deliver the low temperature liquor, high temperature liquor and hot white liquor respectively to a suction side of a digester pump without any additional pumps disposed therebetween.

In an embodiment, the digester pump has an output side that is in communication with both the first inlet of the digester, disposed at a lower end of the digester, as well as a second inlet disposed at the upper end of the digester.

In an embodiment, the suction side of the digester pump is in communication with a recirculation outlet of the digester and, in a recirculation mode, the digester pump recirculates fluid from the recirculation outlet, through a digester heater to the upper end of the digester. Thus, the digester pump serves the functions of pumping displacement fluid in the form of filtrate, low temperature liquor and high temperature liquor as well as cooking fluid in the form of high temperature liquor and hot white liquor as well as circulating the cooking liquor through the digester heater.

In an embodiment, the output side of the digester pump is further in communication with a digester tank and, accordingly, the digester pump further serves the function of pumping out the filtrate and pulp after the cook.

In an embodiment, the upper end of the digester further includes a first outlet for selectively transmitting displaced filtrate and low temperature liquor to a cool liquor return vessel, displaced low temperature liquor and high temperature liquor to the low temperature accumulator and displaced hot white liquor and high temperature liquor to the high temperature accumulator.

In an embodiment, the cool liquor return vessel is a flash tank thereby eliminating the need for a separate cool tank. In such an embodiment, washer filtrate is used as the cool pad fluid.

In an embodiment, the cool liquor return tank is a non-pressurized vessel in communication with a booster pump and the fluid contained therein is used as the cool pad.

In an embodiment, the high temperature accumulator comprises two separate vessels.

In an embodiment, the high temperature accumulator comprises three separate vessels.

In an embodiment, the apparatus of the present invention does not require a separate warm fill pump or hot fill pump or the associated headers and instrumentations of the warm fill pump and hot fill pump.

In an embodiment, the apparatus of the present invention does not require a separate cool pad pump, that function being served by the displacement pump associated with the filtrate reservoir. Accordingly, an embodiment of the present invention does not require the header and associated instrumentation required with employment of a separate cool pad pump.

In an embodiment, the apparatus of the present invention does not require the employment of a separate dilution pump or the header and instrumentation required for the employment of a separate displacement pump.

In an embodiment, the cool pad pump, displacement pump and dilution pump functions are all served by a single pump disposed between the washer filtrate reservoir and the digester.

The present invention also provides an improved method of displacement batch digestion cooking. The method of the present invention includes the steps of filling the digester with wood chips, filling the digester with filtrate from the filtrate reservoir, displacing the filtrate out of the digester with low temperature liquor injected into the digester from an output side of a digester pump. The low temperature liquor being supplied from a low temperature accumulator which has been sufficiently pressurized and which provides a sufficient hydrostatic head to deliver the low temperature liquor to a suction side of the digester pump without any pump other than the digester pump being disposed between the digester and the low temperature accumulator. The method further includes the step of displacing the low temperature liquor out of the digester with a high temperature liquor injected into the digester from the output side of the digester pump. The high temperature liquor being supplied from a high temperature liquor accumulator which has been sufficiently pressurized and which provides a sufficient hydrostatic head to deliver the high temperature liquor to the suction side of the digester pump without any pump other than the digester pump disposed between the digester and the high temperature accumulator. The method further includes the step of displacing at least a portion of the high temperature liquor out of the digester with a hot white liquor injected into the digester from the output side of the digester pump. The hot white liquor is supplied from a hot white liquor accumulator which has been sufficiently pressurized and which provides a sufficient hydrostatic head to deliver the hot white liquor to the suction side of the digester pump without any pump other than the digester pump being disposed between the digester and the hot white liquor accumulator. The final step of the method of the present invention is the cooking of the wood chips in the hot white liquor and high temperature liquor.

In an embodiment, the method of the present invention includes the further step of circulating hot liquor from the lower end of the digester, through the digester pump and through a digester heater and to the upper end of the digester during the cook.

It is therefore an advantage of the present invention to provide a method and apparatus for performing a displacement batch digestion process which does not include a separate booster pump between the low temperature accumulator and the digester.

It is therefore an advantage of the present invention to provide a method and apparatus for performing a displacement batch digestion process which does not include a separate booster pump between the high temperature accumulator and the digester.

It is therefore an advantage of the present invention to provide a method and apparatus for performing a displacement batch digestion process which does not include a separate booster pump between the hot white liquor accumulator and the digester.

It is also an advantage of the present invention to provide an improved displacement batch digestion process and apparatus for carrying out a displacement batch digestion process wherein the cool pad pump displacement pump and dilution pump functions are all performed by a single booster pump.

Yet another advantage of the present invention is the elimination of the need for a separate cool tank.

Another advantage of the present invention is the employment of washer filtrate as the cool pad instead of using a separate cooled liquid disposed in a cool tank for the cool pad.

Still another advantage of the present invention is that it provides a method and apparatus for carrying out a displacement batch digestion cooking system which does not require the employment of separate recirculation and pump-out pumps, both of these functions being combined into a single digester pump.

And, another advantage of the present invention is the elimination of multiple headers and instrumentations with the elimination of numerous previously required pumps.

These and other objects and advantages of the present invention will become more fully apparent as the following description is read in conjunction with the accompanying drawings.

BRIEF DESCRIPTION OF THE DRAWINGS

The invention is illustrated more or less diagrammatically in the accompanying drawings, wherein.

It will be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should also be understood, of course, that the invention is not necessarily limited to the particular embodiments illustrated herein.

DETAILED DESCRIPTION OF THE PRESENTLY PREFERRED EMBODIMENTS

Figure 1:
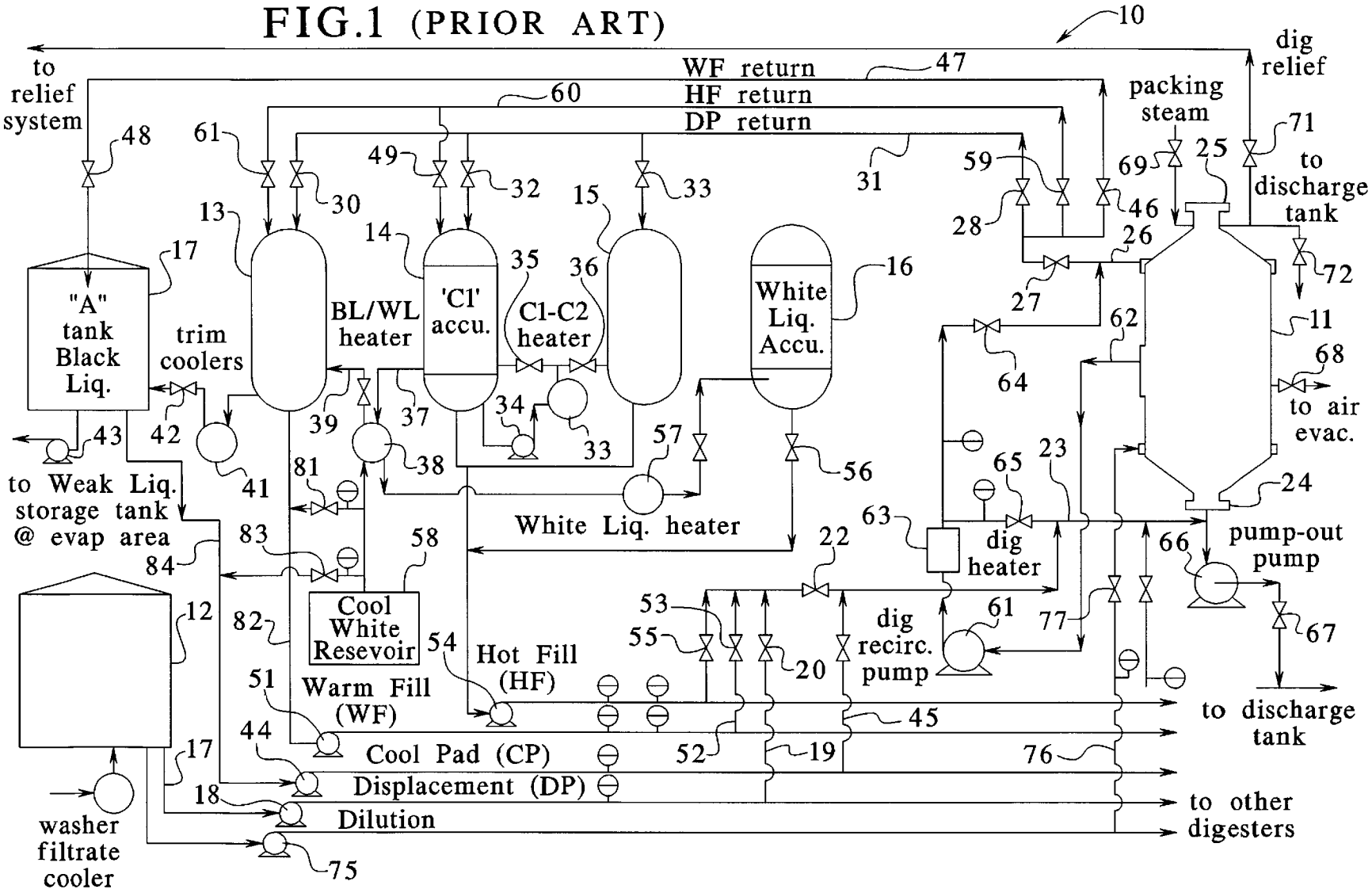
FIG.1 (PRIOR ART)
FIG. 1 is a schematic illustration of a prior art displacement batch digester apparatus.

Like reference numerals will be used to refer to like or similar parts previously described with respect to the prior art apparatus illustrated in FIG. 1.

Figure 2:
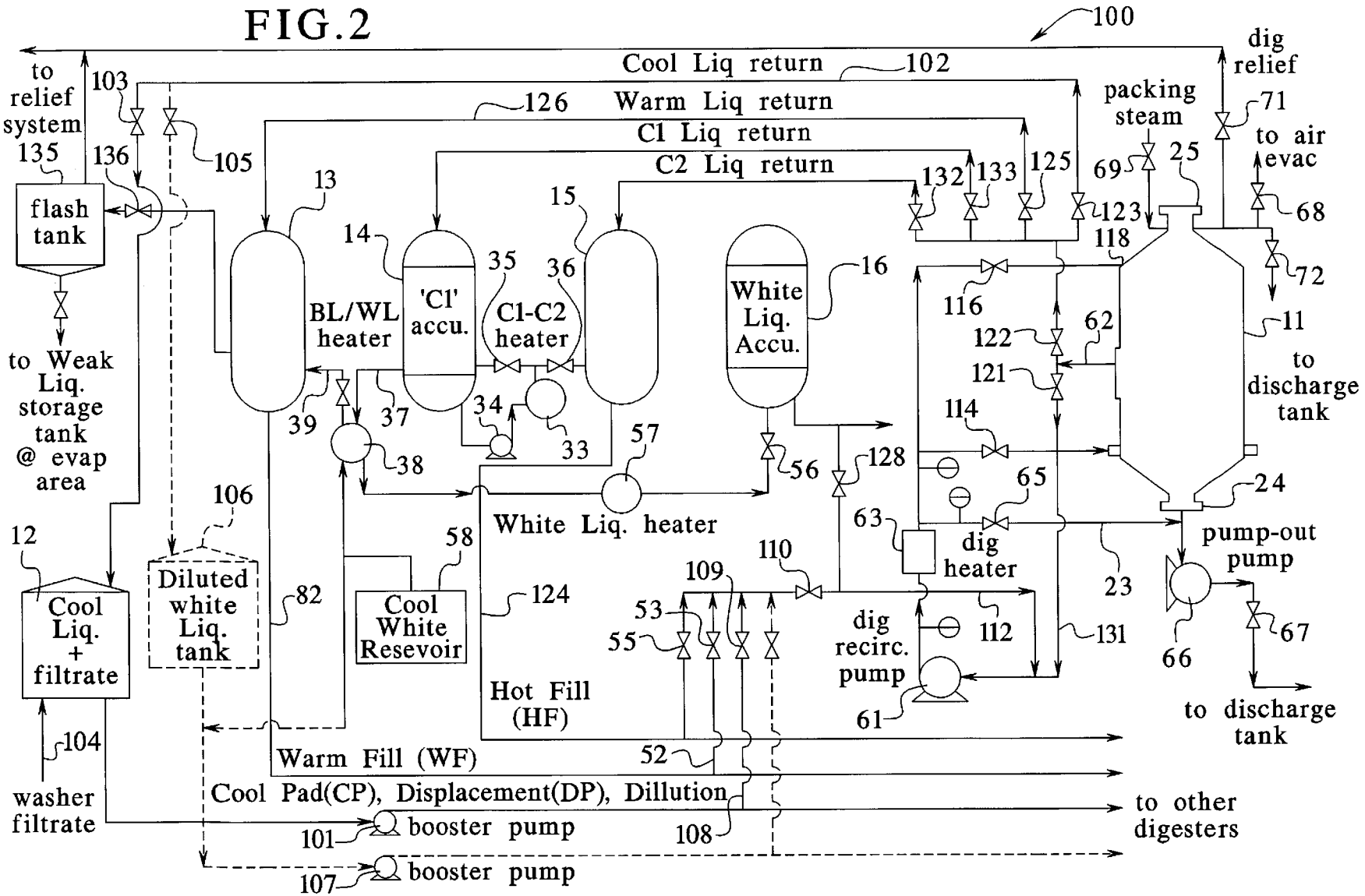
FIG. 2 is a schematic illustration of a first embodiment of a displacement batch digester apparatus in accordance with the present invention.

Turning first to FIG. 2, a system or apparatus 100 is illustrated in which numerous components from the prior art process illustrated in FIG. 1 have been deleted. As can be seen from FIG. 2, there is no warm fill pump like the one shown at 51 in FIG. 1, no hot fill pump like the one shown at 54 in FIG. 1 and further, in the solid line version shown in FIG. 2, the previously required cool pad pump, displacement pump and dilution pump functions have been incorporated into a single booster pump shown at 101.

In this embodiment, cool liquid such as the cool pad and liquid pumped into the digester from the low temperature accumulator 13 is returned through a cool return line 102, through a valve 103 and into the filtrate reservoir 12. This liquid, in addition to washer filtrate supplied through the conduit 104 serves as both the fluid for the cool pad, initial displacement of the spent hot liquor as well as the dilution fluid during the flushing and pumping out of the digester with the pump-out pump 66.

In an alternative embodiment also shown in FIG. 2, the cool liquor returns through the line 102 and valve 105 before being deposited into a separate diluted white liquor tank 106 which serves as the fluid for the cool pad. In this embodiment, a separate cool pad pump 107 is required.

In operation, still referring to FIG. 2, the digester 11 is filled with wood chips which are packed with steam provided through the valve 69. A cool pad is then provided from either the washer filtrate reservoir 12, through the booster pump 101, through a conduit 108 through valves shown at 109 and 110 into a conduit 112 which leads into the suction side of the digester recirculation pump 61. The digester recirculation pump 61 pumps the cool pad fluid through the digester heater 63 (which may be inactivated at this time) before splitting the flow of the fluid through two valves 65 and 116 which lead into the lower end 24 and upper end 25 of the digester respectively. Specifically, the lower valve 65 leads into the lower end 24 of the digester 11 while the upper valve 116 leads into the second inlet 118 disposed toward the upper end 25 of the digester 11.

After the cool pad fluid is in place, fluid from the low temperature accumulator 13 proceeds through the conduit 82, under the hydrostatic head provided by the accumulator 13 and steam pressure (not shown) provided in the accumulator 13, toward the suction side of the recirculation pumps or digester pumps 61 by way of the conduit 52, the valves 53 and 110 and the conduit 112. Again, using the top and bottom displacement system more thoroughly discussed in U.S. Pat. Nos. 5,059,284 and 5,080,757, the digester recirculation pump 61 pumps the fluid through the lower valve 65 and upper valve 116 into the lower end 24 and upper end 25 of the digester 11 simultaneously. Displaced cool pad fluid exits the digester 11 through the recirculation conduit 62. In this part of the process, a valve 121 is closed while a valve 122 is open thereby communicating the displaced cool pad fluid up through the valve 122 and through an open valve 123 into the cool liquid return line 102 before passing through the valve 103 into the filtrate reservoir 12 or, alternatively, through the valve 105 into the diluted white liquid reservoir tank 106.

Still referring to FIG. 2, the cool liquid now disposed in the digester 11 is displaced by hot liquid from the accumulators 14 and 15 as follows. Hot liquor proceeds down through a conduit 124 under the hydrostatic head provided by the accumulators 14, 15 and by steam pressure provided in each accumulator (not shown). Accordingly, the hot fill line 124 does not need a separate booster pump. The hot liquor flows through the line 124, through the valves 55 and 110 and into the suction line 112 for the digester pump 61 where it is pumped into both the first inlet 65 of the lower end 24 and the second inlet 118 of the upper end 25 of the digester 11 simultaneously. The displaced cool liquor flows out through the recirculation conduit 62, up through the valves 122 and 125 into the warm liquor return line 126. Of course, depending upon the temperature of the returned liquor, the flow can be diverted to the cool liquor return line 102.

Still referring to FIG. 2, the contents of the cooking fluid must now be adjusted to include the appropriate amount of fresh white liquor from the hot white liquor accumulator 16. Accordingly, hot white liquor flows through a conduit 127 and a valve 128 into the suction line 112 to the digester pump 61. During the introduction of hot white liquor into the digester 11, excess hot liquor flows out through the conduit 62, through the valve 122 and through either the valves 132, 133 and into the high temperature accumulators 15, 14 respectively.

Again, the hot white liquor is pumped into both the first inlet 65 of the lower end 24 of the digester and the second inlet 118 of the upper end 25 of the digester simultaneously. Now, the cook is ready to begin. During the cook, the temperature inside the digester 11 may be adjusted by circulating cooking fluid through the recirculation conduit 62, through the valve 121, through the digester recirculation pump 61 before it passes through the digester heater and back into the upper inlet 118 and lower inlet 65 of the digester 11. During the recirculation procedure, the valve 122 is closed.

Accordingly, the system 100 as shown in FIG. 2 substantially reduces the number of pumps required because no separate warm fill pump, hot fill pump or hot white liquor accumulator pump are required. Further, the displacement pump and dilution pump functions are combined into a single pump 101 or, alternatively, the cool pad pump, displacement pump and dilution pump functions are combined into the single booster pump 101. Still further, the cool tank 17 (see FIG. 1) has been eliminated in favor of a flash tank 135. The flash tank 135 serves as an overflow for the low temperature accumulator 13. Fluid from the low temperature accumulator 13 passes through the valve 136 and into the flash tank 135 in the event the low temperature accumulator 13 becomes full. Further, because the tank 135 is a flash tank, the need for a trim cooler (see 41 in FIG. 1) is eliminated.

Figure 3:
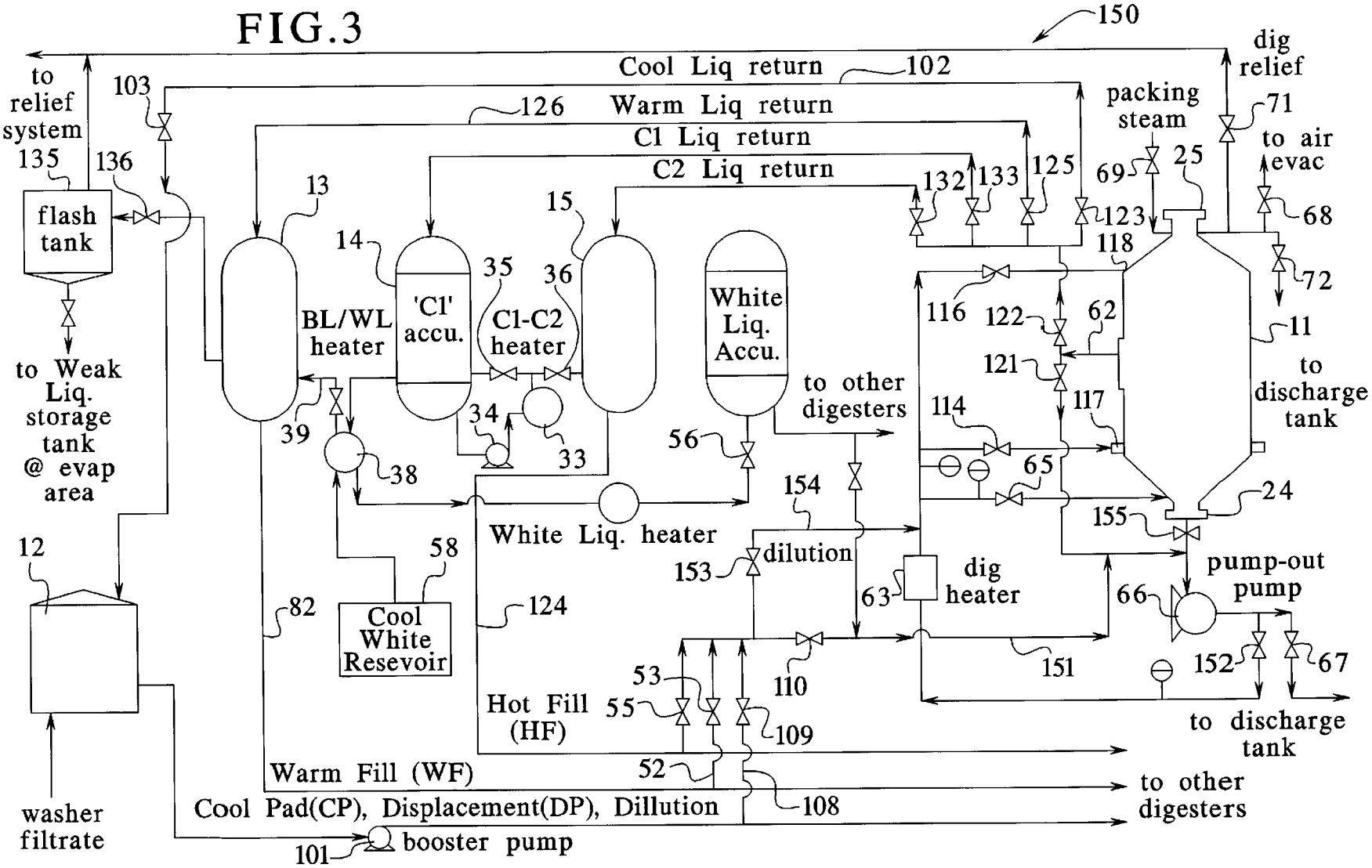
FIG. 3 is a schematic illustration of a second embodiment of a displacement batch digester apparatus in accordance with the present invention.
Figure 5:
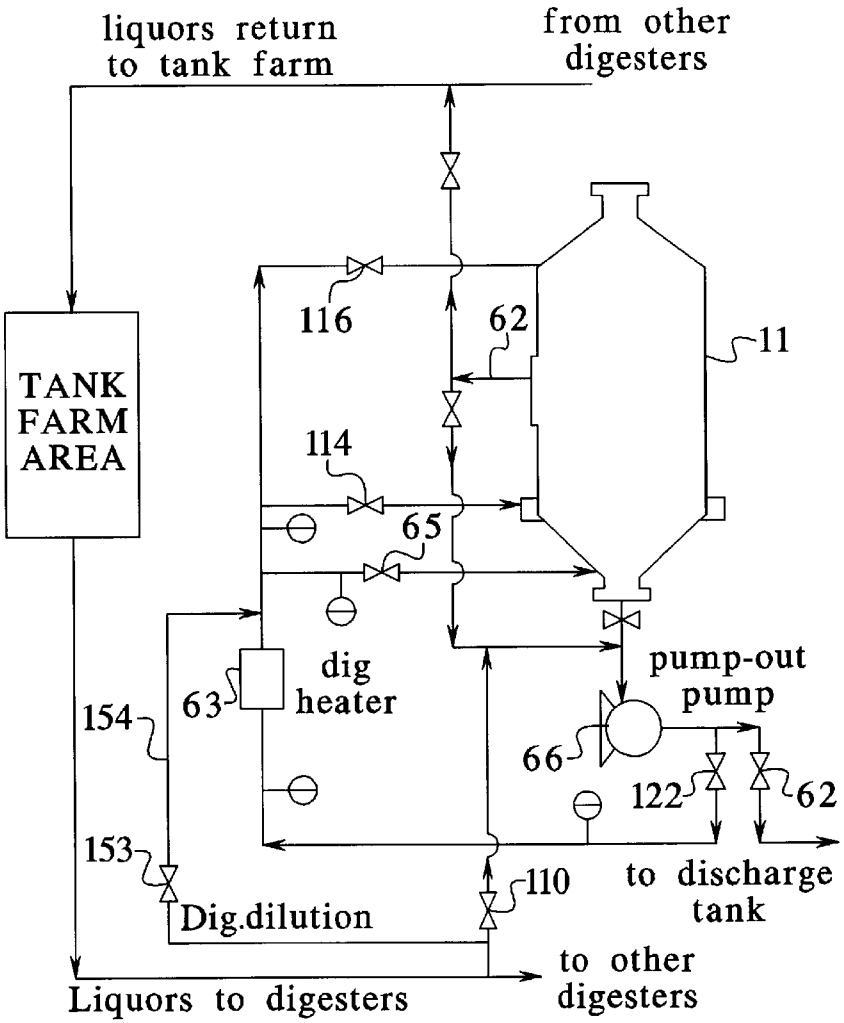
FIG. 5 is an abbreviated schematic illustration of the apparatus shown in FIG. 3.
Figure 4:
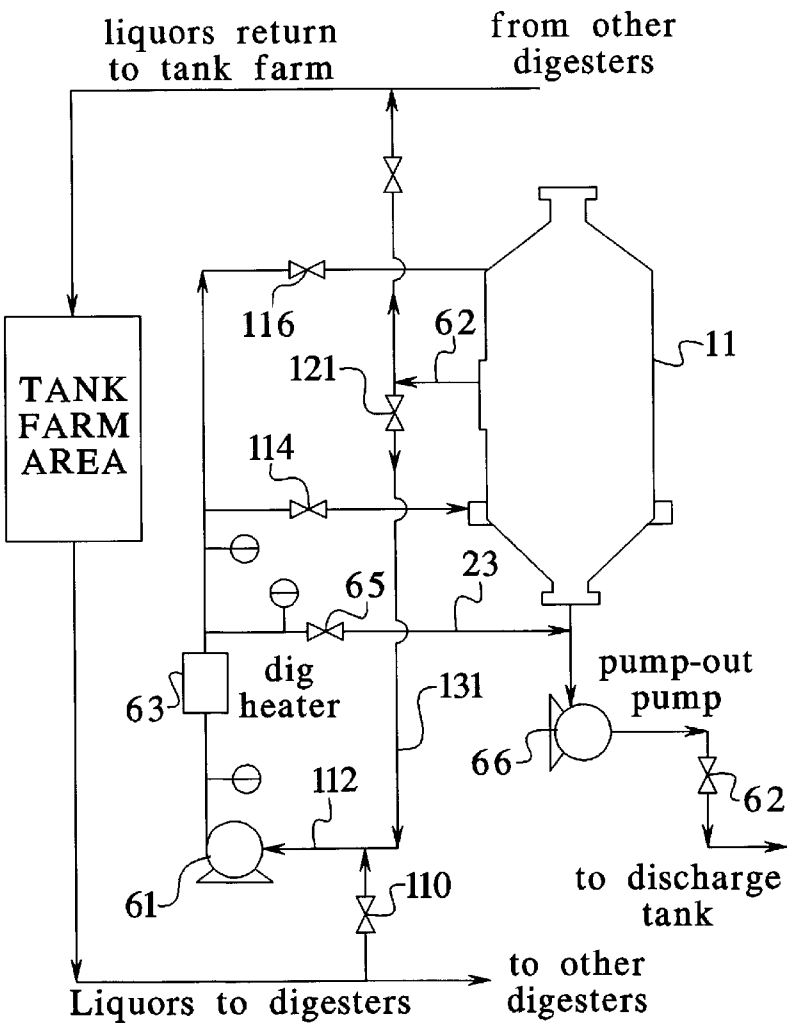
FIG. 4 is an abbreviated schematic illustration of the apparatus shown in FIG. 2.

Turning to FIG. 3, the reader will note that the cool liquid return line 102 feeds directly into the washer filtrate reservoir 12 and the cool pad pump displacement pump and dilution pump functions are all performed by the common booster pump 101. Further, like the system 100 shown in FIG. 2, the system 150 does not include a warm fill pump or hot fill pump disposed between the low temperature accumulator 13 or between the high temperature accumulators 14, 15 and the digester 11. However, in the system 150 shown in FIG. 3, the separate recirculation pump 61 (see FIGS. 1 and 2) has been eliminated and this function is provided by the combination pump-out/recirculation pump shown at 66. Specifically, during a displacement, from either the low temperature accumulator 13 or high temperature accumulators 14, 15, the displacement fluid passes through the valve 110 in the same fashion as shown in FIG. 2 but the input line 151 has been rerouted to the suction side of the pump 66, the pump 61 having been eliminated. The pump 66 pumps the displacement fluid through a valve 152 which leads to the input side of the digester heater 63. During recirculation, a valve 155 disposed between the pump 66 and the lower end 24 of the digester 11 is closed. The flow after the digester heater 63 is the same as that illustrated in FIG. 2 and will not be repeated. Further, during the dilution operation, fluid is pumped from the reservoir 12 by the booster pump 101, through the conduit 108 and valves 109 and 153 into a separate dilution line 154. The dilution line 154 is required because, during the dilution operation, the filtrate and pulp is being discharged through the valves 155 and 67 and it is necessary to inject the dilution fluid into the top inlet 1 18 of the digester 11, through the valve 65 into the bottom 24 of the digester 11 and through the valve 114 into the inlet 117.

In the embodiments illustrated in FIGS. 2 and 3, the upper inlet 118 to the digester preferably feeds into a liquid spray nozzle (not shown). Further, in the systems 100 and 150, the air evacuation valve 68 has been moved to the upper end 25 of the digester 11 and adjacent to the discharge valve 72.

Accordingly, as illustrated in FIG. 3, in addition to the elimination of the warm fill and hot fill pumps and the consolidation of the cool pad pump displacement pump and dilution pumps into a single booster pump 101, the system 150 further eliminates a separate recirculation pump 61 (see FIGS. 1 and 2) and consolidates the recirculation and pump-out functions into the single pump 66. The cool tank has also been eliminated.

While only three particular embodiments of the present invention have been described, modifications and variations are possible without departing from the spirit and scope of the present invention. Included within the invention, therefore, are such modifications and variations that would be apparent to one skilled in the art.

What is claimed is:

1. An apparatus for digesting a mass of cellulose pulp with a digesting liquor in a displacement heating batch digesting process, wherein the pulp is cooked at an elevated temperature and elevated pressure in the digester, the apparatus comprising:

a digester comprising an upper end and a lower end and a middle portion, the lower end comprising a first inlet, the upper end comprising a second inlet, the first and second inlets for selectively receiving displacement fluid in the form of filtrate from a filtrate reservoir, low temperature liquor from a low temperature accumulator, high temperature liquor from a high temperature accumulator and a hot white liquor from a hot white liquor accumulator, the middle portion comprising a first outlet for selectively transmitting displaced low temperature liquor to a flash tank, displaced high temperature liquor to the low temperature accumulator and displaced hot white liquor high temperature liquor to the high temperature accumulator, at least one of the low temperature accumulator, high temperature accumulator and hot white liquor accumulator being pressurized and further providing a sufficient hydrostatic head to deliver the low temperature liquor, high temperature liquor or hot white liquor, respectively, to a suction side of a digester pump without an additional pump disposed therebetween, the digester pump having an output side that is in communication with the first and second inlets of the digester.

2. The apparatus of claim 1 wherein the low temperature accumulator, the high temperature accumulator and the hot white liquor accumulator each being pressurized and further providing a sufficient hydrostatic head to deliver the low temperature liquor, high temperature liquor and hot white liquor respectively to the suction side of the digester pump without any additional pumps disposed therebetween.

3. The apparatus of claim 2 wherein the high temperature accumulator comprises two separate vessels.

4. The apparatus of claim 2 wherein the high temperature accumulator comprises three separate vessels.

5. The apparatus of claim 1 wherein the output side of the digester pump is further in communication with a discharge conduit, in a discharge mode, the digester pump pumping liquor out of the digester and through the discharge conduit.

6. The apparatus of claim 1 wherein the suction side of the digester pump is in communication with the first outlet of the digester and, in a recirculation mode, the digester pump recirculates fluid from the recirculation outlet, through a digester heater to an upper end of the digester.

7. An apparatus for digesting a mass of cellulose pulp with a digesting liquor in a displacement heating batch digesting process, the apparatus comprising:

a digester comprising a bottom portion, a top portion and middle portion, the bottom portion comprising a first inlet, the top portion comprising a second inlet, the first and second inlets for selectively receiving displacement fluid in the form of filtrate from a filtrate reservoir, low temperature liquor from a low temperature liquor accumulator, high temperature liquor from a high temperature liquor accumulator and hot white liquor from a hot white liquor accumulator, the middle portion of the digester comprising a recirculation outlet, the low temperature accumulator, high temperature accumulator and hot white liquor accumulator each being pressurized and further providing a sufficient hydrostatic head to deliver the low temperature liquor, high temperature liquor and hot white liquor respectively to a suction side of a digester pump without additional pumps disposed between the digester pump and either the lower temperature accumulator, the high temperature accumulator or the hot white liquor accumulator, the digester pump having an output side that is in communication with both the first inlet of the digester and a second inlet of the digester, the suction side of the digester pump being in communication with the recirculation outlet of the digester, in a recirculation mode, the digester pump recirculating fluid from the recirculation outlet, through a digester heater and to the first and second inlets of the digester, the recirculation outlet is also connected to a flash tank, the low temperature liquor accumulator and the high temperature liquor accumulator, the recirculation outlet for selectively transmitting displaced low temperature liquor to the flash tank, displaced high temperature liquor to the low temperature liquor accumulator and displaced hot white liquor to the high temperature liquor accumulator.

8. The apparatus of claim 7 wherein the digester pump is the only pump disposed between the low temperature accumulator, high temperature accumulator and hot white liquor accumulator.

9. The apparatus of claim 7 wherein the high temperature liquor accumulator comprises two separate vessels.

10. The apparatus of claim 7 wherein the output side of the digester pump is further in communication with a discharge conduit, in a discharge mode, the digester pump pumping liquor out of the digester through the discharge conduit.

* * * * *